US007017276B2

(12) United States Patent
Greenspan et al.

(10) Patent No.: US 7,017,276 B2
(45) Date of Patent: Mar. 28, 2006

(54) HEARING AID DRYER

(76) Inventors: Bernard Jay Greenspan, 17836 Creciente Way, San Diego, CA (US) 92127; Eliot N. Pierce, 12039 Caminito Cadena, San Diego, CA (US) 92128; David K. Woodruff, 11835 Carmel Mountain Rd., Suite 1313, San Diego, CA (US) 92128

( * ) Notice: Subject to any disclaimer, the term of this patent is extended or adjusted under 35 U.S.C. 154(b) by 0 days.

(21) Appl. No.: 10/859,807

(22) Filed: Jun. 3, 2004

(65) Prior Publication Data

US 2004/0244215 A1 Dec. 9, 2004

Related U.S. Application Data

(60) Provisional application No. 60/476,539, filed on Jun. 6, 2003.

(51) Int. Cl.
*F26B 25/06* (2006.01)

(52) U.S. Cl. ..... 34/80; 34/201; 34/202; 34/87

(58) Field of Classification Search ..... 99/331, 99/468; 34/201, 202, 87
See application file for complete search history.

(56) References Cited

U.S. PATENT DOCUMENTS

| | | | | |
|---|---|---|---|---|
| 4,959,976 | A | 10/1990 | Matsuda et al. | |
| 5,048,201 | A | 9/1991 | Layton | |
| 5,569,403 | A * | 10/1996 | Swanson et al. | 219/400 |
| 5,640,783 | A | 6/1997 | Schumaier | |
| 5,852,879 | A | 12/1998 | Schumaier | |
| 5,901,464 | A | 5/1999 | Kazakis et al. | |
| 5,968,386 | A | 10/1999 | Goenka et al. | |
| 6,399,920 | B1 | 6/2002 | Guinn | |
| 6,675,492 | B1 | 1/2004 | Hsu | |
| 2003/0196687 | A1 | 10/2003 | Campbell | |
| 2004/0255791 | A1 * | 12/2004 | Payen | 99/331 |

OTHER PUBLICATIONS

International Search report and Written Opinion for PCT/US04/17525.
Halhen Corporation—Product information for Mini Dri-Aid Hearing Aid Dehumidifier (www.halhen.com).
Cochlear Corporation, Instruction Sheet for Dri-Aid, Jul. 1998. Indicates need to heat desiccant at 176C (350F) in an oven.

* cited by examiner

*Primary Examiner*—Kenneth Rinehart

(57) ABSTRACT

An apparatus is disclosed for removing moisture from electronic devices such as hearing aids, using a desiccant material. The desiccant material is regenerated in place with heat from an embedded heater when the apparatus is open to the atmosphere. Drying of the hearing aids takes place when the hearing aids are placed in the apparatus and it is closed. Heat is not applied during drying to avoid potential damage to the hearing aids or other electronic device.

8 Claims, 6 Drawing Sheets

HEARING AID DRYER

CROSS-REFERENCE TO RELATED APPLICATIONS

This application claims the benefit of U.S. Provisional Application Ser. No. 60/476,539, filed Jun. 6, 2003.

BACKGROUND OF THE INVENTION

The present invention is directed toward an appliance capable of reducing or eliminating moisture damage to sensitive electronic devices such as hearing aids. Current trends in micro circuitry have enabled the production of hearing aids which reside partially or completely in the ear canal. This exposes the devices to a warm and moist environment and presents the opportunity for moisture damage to the circuits and possibly ultimate failure of the device. Additionally, for hearing-aid wearers residing in humid environments, moisture damage can occur even when the hearing aid is not being worn.

There are several means currently available to hearing aid wearers for protecting their devices from moisture damage while they are not being worn.

The simplest device is a jar with a screw-lid containing desiccant material inside and a piece of foam or other material separating the storage area from the desiccant.

A second device, as exemplified in U.S. Pat. Nos. 5,640,783 and 5,852,879, seeks to provide both drying and bactericidal activity. This device utilizes a fan to circulate air through the chambers of the unit. A heater is provided to assist in moisture removal, and sensing circuitry is required to ensure that the heater does not damage the hearing aids by raising the air to too high a temperature. The commercial embodiment of this invention is made to sit on a dresser or night-stand.

A third device (U.S. Pat. No. 6,399,920) provides warmed air, maintained below a critical temperature to avoid damaging the sensitive circuitry and a desiccant to absorb moisture liberated by the warmed air.

At some point, the desiccant material used in the above-described devices becomes depleted (saturated with moisture) and the user must either purchase another unit, supply fresh desiccant, or regenerate the desiccant material by heating it to a high temperature in a conventional or microwave oven. By conventional methods, the desiccant material is regenerated by exposure to high temperatures, in excess of 100 degrees Celsius. The process of regenerating is not only inconvenient, it presents a safety hazard to older patients who may lack the dexterity to safely handle the resulting hot desiccant material.

Therefore, there is a need in the field to provide a de-moisturizing appliance wherein the desiccant material is regenerated without the necessity of removal from the appliance.

We have surprisingly found, however, that the silica gel can also be regenerated by exposure to lower temperatures for longer periods of time. As will be disclosed below, the temperature of the desiccant bed remains below approximately 65 degrees Celsius, ensuring that the temperature at the surface of the container remains below approximately 57 degrees Celsius.

The available devices cannot regenerate the desiccant material. They only heat the chamber when the lid is closed, thereby not allowing the moisture in the desiccant to escape the appliance. The present invention works in the opposite way, with the lid open during operation of the heater.

It is the aim of the present invention to provide a simple to use, portable drying apparatus with a desiccant capable of being regenerated without removal. This invention eliminates the expense of purchasing fresh desiccant, as well as the inconvenience and safety hazards associated with regenerating the desiccant as required for currently available devices.

SUMMARY OF THE INVENTION

The invention is an apparatus for drying a moisture sensitive device, comprising a container with a removable cover that forms a seal with the lower portion of the container when closed. The container is divided into two compartments; one to hold a device to be dried, and a second compartment containing a desiccant material and a circuit to heat the desiccant during a regeneration during a regeneration cycle. A perforated cover over the desiccant compartment allows moisture to pass from the device being dried to the moisture-absorbing desiccant.

The electrical circuit has a resistive heating element connected in series with a power source and a switch, with the switch being controlled by the closure of the cover;

The circuit is activated when the cover is open and it supplies power to the heating element sufficient to regenerate the moisture absorbing capacity of the desiccant material, without posing a safety hazard to the user.

The desiccant material is located in close proximity to the heating element.

DETAILED DESCRIPTION OF THE INVENTION AND PREFERRED EMBODIMENTS

Figure 1:
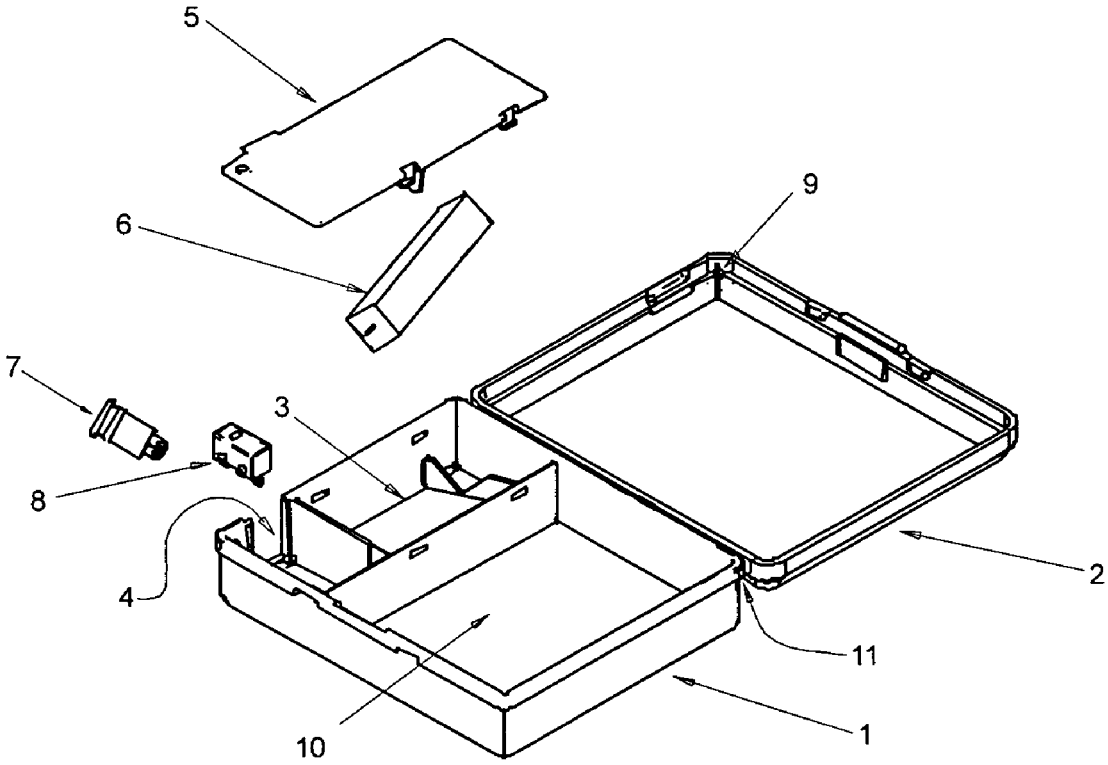
FIG. 1 is an exploded view showing the major components without interconnecting wires.
Figure 2:
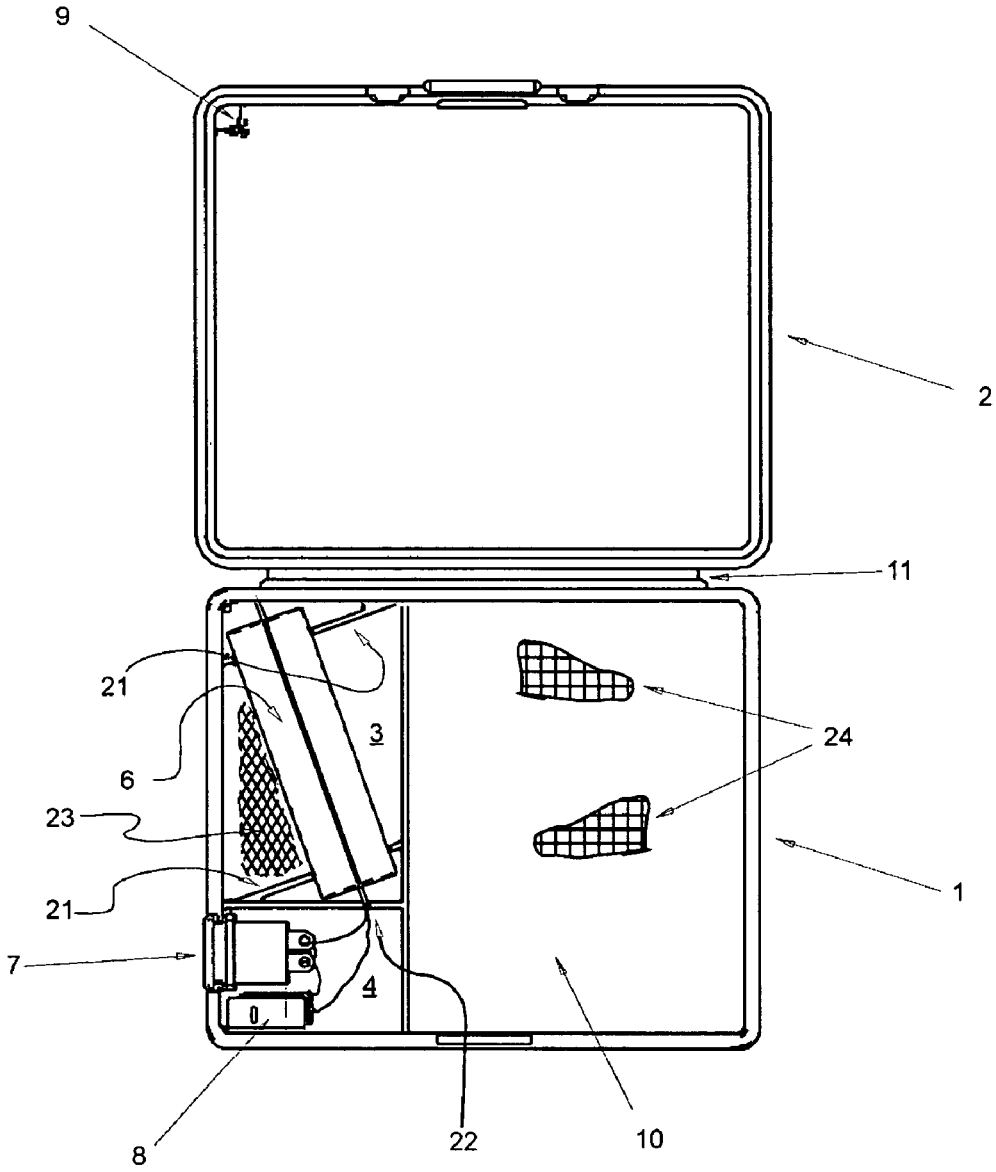
FIGS. 2 and 3 are perspective views from the top and side.
Figure 3:
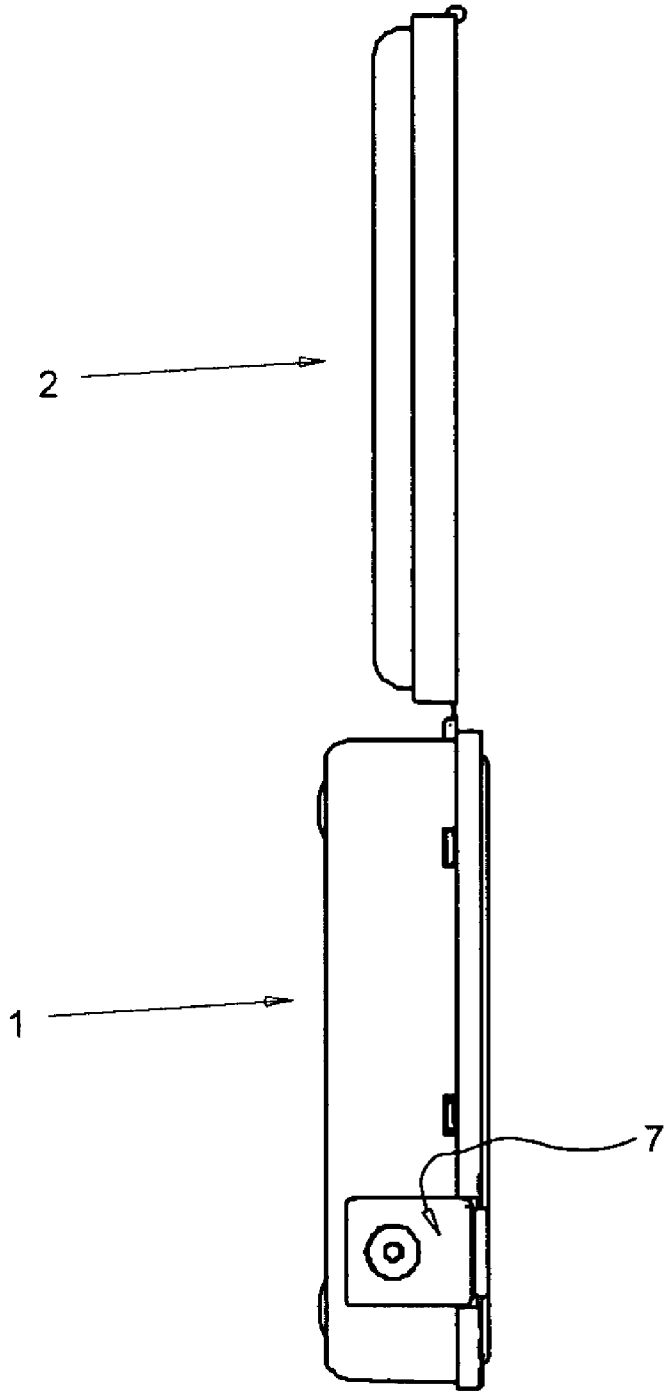

Referring the drawings, and in particular to FIGS. 1, 2 and 3, the invention comprises in one preferred embodiment, a container with a lower portion 1 and a cover 2, preferably attached to the lower portion 1 with a hinge 11. The dimensions of the container are sufficient to hold the desiccant material 23, a resistive heating element 6, and associated circuitry, as well as hearing aids 24. When closed, the cover 2 forms a substantial seal with the lower portion 1, to minimize the entry of humid ambient air into the container. The resistive heating element 6 is supported by two supports 21. A desiccant material 23 is added to the compartment 3, under, around and over the heating element 6. The desiccant material 23 can be silica gel or other heat-regeneratable material. It can be in loose, free-flowing form, or packaged in bags and placed in close proximity to the heating element.

Figure 4:
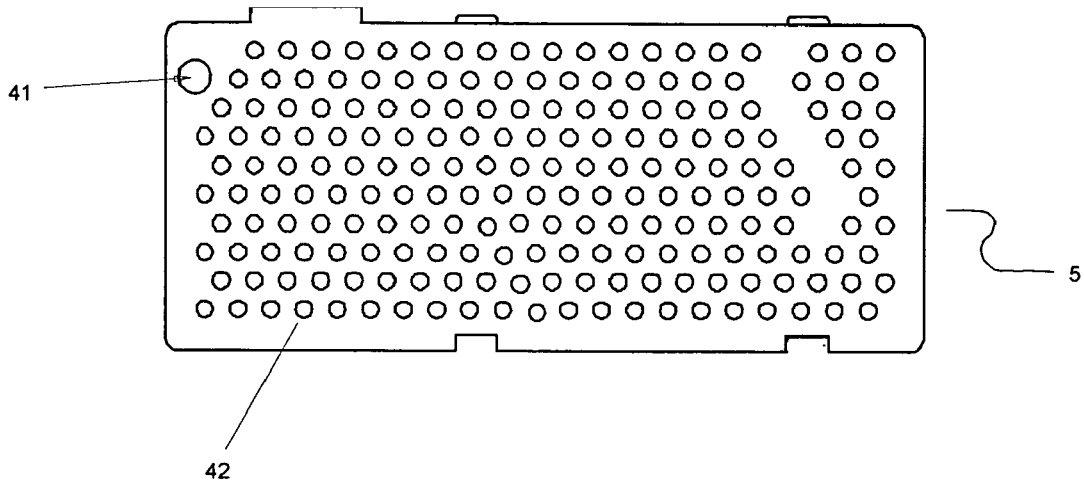
FIGS. 4 and 5 are top and side views of the cover to the desiccant compartment.

The lower portion of the container 1 is divided into two or three compartments; a first compartment 10 to hold the hearing aids, a second compartment 3 containing the desiccant material 23, a heating element 6, a power connector 7, and a switch 8. In a preferred embodiment, the second compartment is divided to form an optional third compartment 4, wherein the switch 8 and power connector 7 are mounted. This configuration causes the desiccant material 23 to be limited to a tightly confined space in close proximity to the heating element 6 to assure regeneration of a greater percentage of the desiccant material. The second compartment 3 containing the desiccant 23 and heating element 6 is covered by a perforated plate 5 to confine the desiccant material 23 to the compartment and allow moisture to escape from the desiccant during the regeneration cycle and to be absorbed by the desiccant when the hearing aids are in the container. The perforated plate 5 is shown in FIG. 4. The plate 5 also has a hole 41 positioned over the button for the switch 8 to allow the protrusion 9 on the cover 2 to activate the switch 8 when the cover 2 is closed. There is a slit 22 in the wall between the second compartment 3 and the optional third compartment 4 to accommodate the wires.

Figure 5:
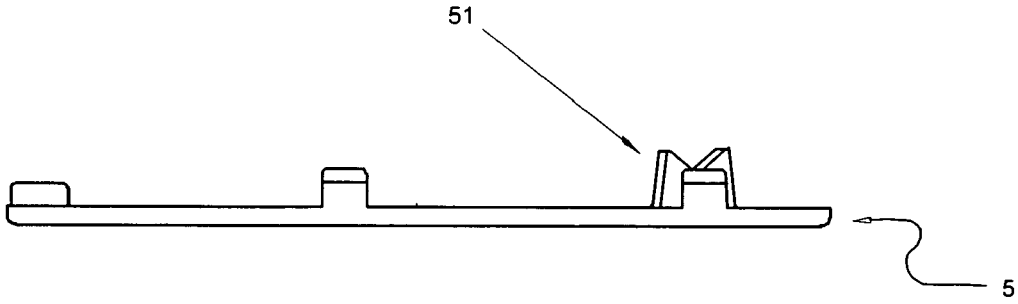

FIG. 5 shows an edgewise view of the perforated plate 5 and a holder 51 for the resistive heating element.

Figure 6:
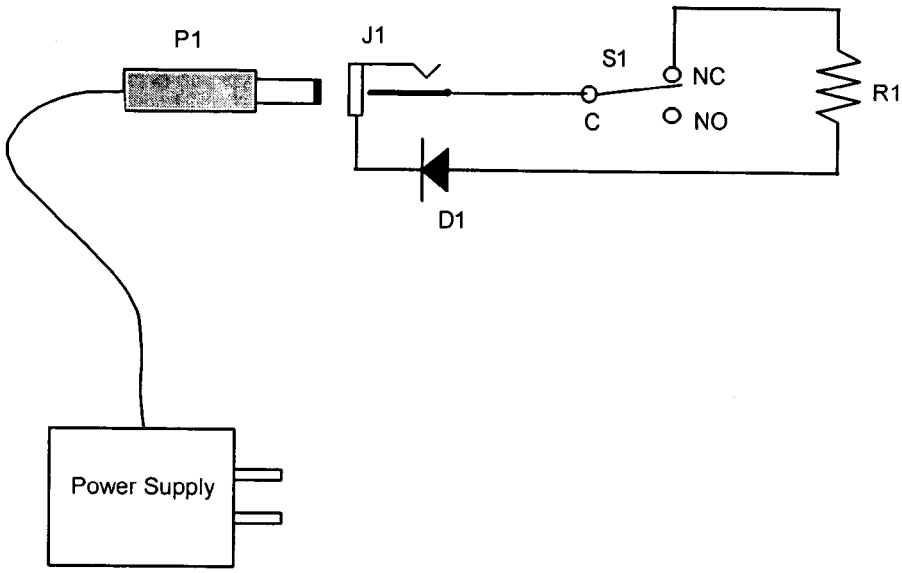
FIG. 6 is the schematic diagram of the electrical circuit. The switch is closed when the cover is open.

FIG. 6 shows the preferred embodiment for the heating circuitry to regenerate the desiccant. The circuit comprises a power connector 7, a switch 8 connected in series to the power connector 7, and a resistive heating element 6 connected in series with the power connector 7 and the switch 8. An optional light emitting diode D1 may be added to the circuit for visual confirmation that it is operating. A low voltage transformer in the power supply is used to step down house voltage (110 or 220 volts AC) to lower voltages as discussed below.

The resistive heating element 6 is preferably a carbon or wire resistor. The voltage applied and the resistance of the resistor are chosen to maintain the power dissipation at or below about 5 watts and preferably between 1 and 3 watts to achieve an internal temperature of approximately 65 degrees Celsius.

Numerous combinations of power supply capacity, voltage, and resistance values of the heating element are possible which remain at or below the approximate 5 watt limit. This limit is preferred to ensure safety by maintaining the temperature low enough to avoid potentially burning the user and to avoid damage to the hearing aids should the device malfunction and remain on while the hearing aids are inside. In another preferred embodiment, the addition of insulation to the heated portion of the apparatus would further increase safety and allow usage of higher power heating elements, in the range of approximately 5 to 10 watts.

The cover of the container 2 incorporates a protrusion 9 to engage the switch 8 and deactivate the heating element 6 when the cover is in place. That is, the heating element 6 is switched off when the cover 2 is closed. An alternate embodiment of the invention utilizes a manually-operated switch or no switch at all. In the latter embodiment, the user connects and disconnects the power supply to control the regeneration process. The power connector 7 is preferably adapted for use with a small, low voltage transformer, although it could be eliminated by direct connection of the power supply to the internal circuitry of the device. Further it is possible to construct the invention with a fully-integrated power supply, such as batteries or solar power cells.

In normal operation, the power supply is connected to the unit at the power connector 7. While the unit is empty of hearing aids, the cover 2 is left in the open position, and the heating element 6 contained in the desiccant compartment 3 is turned on. The heating element 6 is designed to provide upwards to 5 watts, and preferably 1 to 3 watts, so as neither to become hot to the touch nor to reach a temperature within the unit exceeding approximately 57 degrees Celsius, capable of potentially damaging the hearing aids, should they be left inside the unit during a heating cycle.

When the user removes his or her hearing aids 24, they are placed in the first compartment 10 and the cover 2 is closed. The switch 8 opens the electrical circuit supplying power to the heating element 6 and heating of the desiccant material 23 is stopped. The desiccant absorbs moisture from the air in the container and dries the hearing aids.

The desiccant 23 can be poured into the second compartment 3 or be supplied pre-packaged in small bags, or otherwise contained in one or more packages. The desiccant 23 can be located on top of the heating element 6, thereby covering the heating element 6 with the desiccant material 23, or it can be placed along side or otherwise in close proximity to the heating element 6 sufficient to effect regeneration of the desiccant material 23 by the heating element 6 according to the invention as described herein.

Figure 7:
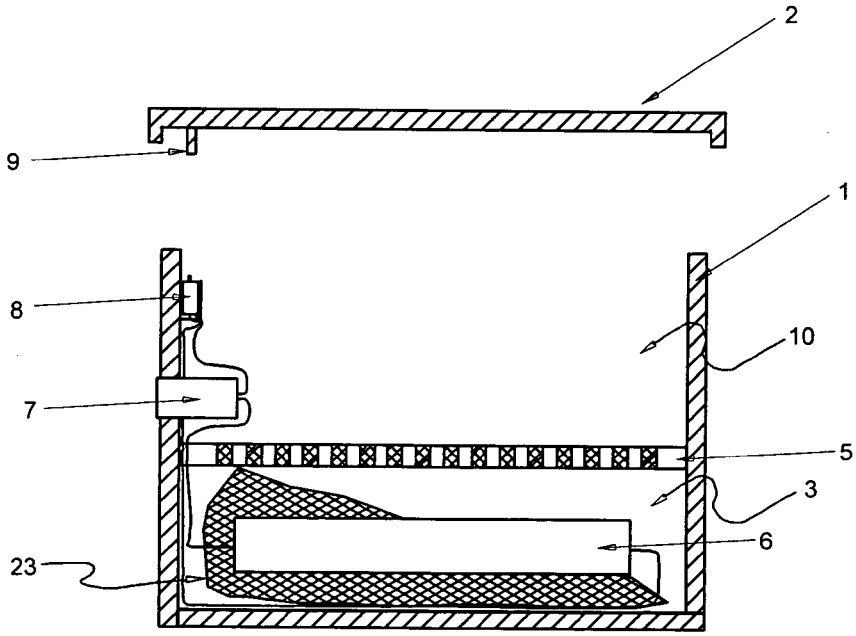
FIG. 7 is cross-sectional view of an alternative embodiment with the drying compartment on top of the desiccant compartment.

FIG. 7 shows another preferred embodiment in which the first compartment 10 and the second compartment 3 are arranged vertically. The protrusion 9 on the cover 2 engages the switch 8 when the cover 2 is in place. Desiccant material 23 is placed in the second compartment 3 in close proximity to the heating element 6. The desiccant material 23 may fill the second compartment 3.

Figure 8:
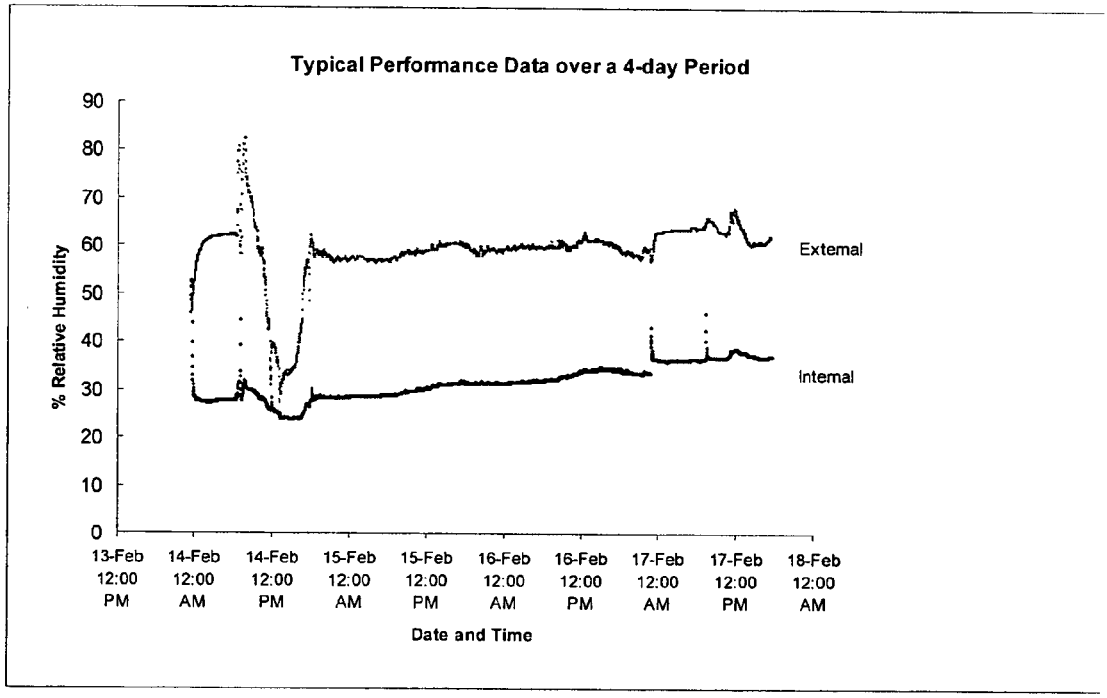
FIG. 8 is a graph showing relative humidity values recorded inside and outside of the apparatus.

As can be seen from the data in FIG. 8, the relative humidity in the closed container with regenerated desiccant can be maintained below 45% despite external humidity excursions up to 80%. Typical values were between 30 and 38% over a 4-day period with external humidity values in the range of 60%. These conditions are conducive to drying of the hearing aids and ear wax adhered to them. Drying adhered ear wax facilitates cleaning.

Because hearing aids come in various shapes and sizes, the container may be manufactured in various shapes and sizes. While the above discussion has focused on hearing aids, it should also be apparent that this device may be used to dry any other moisture sensitive item.

We claim:

1. An apparatus for drying a moisture sensitive device, comprising:

a container with a removable cover and a lower portion, said cover forming a seal with the lower portion of the container when closed;

said lower portion of the container being divided into a first compartment and a second compartment, said first compartment fashioned to hold a device to be dried, and said second compartment containing a desiccant material and a circuit to heat said desiccant material, and said second compartment having a perforated cover to allow passage of moisture;

said circuit comprising a resistive heating element connected in series with a power source and a switch, said switch being controlled by the closure of the cover;

said circuit being activated when the cover is open and supplying power to the heating element sufficient to regenerate the moisture absorbing capacity of said desiccant material;

wherein said desiccant material is located in close proximity to said heating element.

2. The apparatus of claim 1 wherein said heating element is embedded in said desiccant material.

3. The apparatus of claim 1 wherein said cover is connected by a hinge to the lower portion.

4. The apparatus of claim 1 wherein said heating element dissipates up to about 5 watts.

5. The apparatus of claim 1 wherein the heating element dissipates between 1 and 3 watts.

6. The apparatus of claim 1 wherein the heating element is a carbon resistor.

7. The apparatus of claim 1 wherein the heating element is a wire resistor.

8. The apparatus of claim 4, wherein the temperature of the desiccant is maintained at about 67 degrees Celsius during operation of the heating element.

* * * * *